US005297901A

United States Patent [19]

Voss

[11] Patent Number: 5,297,901

[45] Date of Patent: Mar. 29, 1994

[54] INDIVIDUAL HYDRAULIC PROP WITH FILLING/DRAWING VALVE AND PRESSURE FLUID RETURN

[75] Inventor: Richard Voss, Schwerte, Fed. Rep. of Germany

[73] Assignee: Grubenausbau GmbH, Schwerte, Fed. Rep. of Germany

[21] Appl. No.: 973,737

[22] Filed: Nov. 9, 1992

[30] Foreign Application Priority Data

Dec. 6, 1991 [DE] Fed. Rep. of Germany ..... 4140317

[51] Int. Cl.[5] ..... E21D 15/44

[52] U.S. Cl. ..... 405/290; 91/170 MP; 405/288

[58] Field of Search ..... 405/290, 289, 288, 303, 405/291; 248/351; 91/170 MP

[56] References Cited

U.S. PATENT DOCUMENTS

| | | | |
|---|---|---|---|
| 2,621,631 | 12/1952 | Dowty | 405/290 X |
| 4,252,476 | 2/1981 | Koppers et al. | 405/290 |
| 5,051,039 | 9/1991 | Heiliger | 405/290 |

FOREIGN PATENT DOCUMENTS

| | | | |
|---|---|---|---|
| 1408064 | 12/1968 | Fed. Rep. of Germany | 405/290 |
| 2840008 | 10/1979 | Fed. Rep. of Germany | 405/290 |
| 3504878 | 2/1985 | Fed. Rep. of Germany . | |
| 8912529 | 10/1989 | Fed. Rep. of Germany . | |
| 116774 | 11/1959 | U.S.S.R. | 405/290 |
| 507701 | 4/1976 | U.S.S.R. | 405/290 |
| 2076121 | 11/1981 | United Kingdom | 405/290 |

*Primary Examiner*—Dennis L. Taylor

*Attorney, Agent, or Firm*—James Creighton Wray

[57] ABSTRACT

For use in underground individual prop support, an individual prop valve is provided whose case integrates a return valve for setting, a non-return valve for drawing, and a pressure-limiting valve for securing the prop against overload. The valve case of the pressure-limiting valve is moved hydraulically if the case is also equipped on the drawing side with a coupling piece which has a gripping groove and locking shoulder. A push bolt which is loaded correspondingly by the pressure fluid acts on the valve case and moves it by a predefined length, so that the non-return valve is hereby opened and the pressure fluid is able to flow from the prop interior through the suction pump connection located on the setting side. Here the channels or spaces are proportioned in such a way that an increased amount of pressure fluid may be discharged, whereby this process is supported by a pump connected to the suction pump connection.

12 Claims, 2 Drawing Sheets

INDIVIDUAL HYDRAULIC PROP WITH FILLING/DRAWING VALVE AND PRESSURE FLUID RETURN

BACKGROUND OF THE INVENTION

The invention relates to a hydraulic prop for individual prop support in underground mining and tunnel construction, with a filling and drawing valve integrated in the prop head, whereby said filling and drawing valve has on the end side of its case a coupling piece for the setting gun with a gripping groove and locking shoulder and on the inside a return valve for setting, a non-return valve for drawing, and a pressure-limiting valve for securing the prop against overload, whereby the valve case of the pressure-limiting valve at the same time represents the piston for the non-return valve which has a seal shoulder which is formed in a corresponding manner with the seal seat at the inside case wall and whereby the pressure medium is removed in an environmentally harmless manner via a hose connection which may be clamped to the coupling piece.

Individual hydraulic props are used strategically in underground mining and in tunnel construction in order to secure cavities which were created by mining. For this purpose they are clamped between top wall and footwall or between floor and head. In addition, they are also used in the longwall in the transition area, where due to the daily progress in the mining they must then be moved one or several times a day. Their use is also mandatory in situations where due to rock conditions a shield-type support or a similar support cannot be used or can only be used with great difficulties. This applies also for semi-steep positioning. Especially if the hydraulic props must be moved daily, the pressure fluid, which consists of a water-oil mixture, in the past was sprayed into the environment during the drawing, thus causing the retraction of the hydraulic prop. Although the water-oil mixture contains only small amounts of oil, it cannot be avoided that the sprayed pressure fluid reaches the shaft bottom and is pumped from there to the surface, where it then automatically and inevitably causes environmental burdens. In addition, this process only permits a one-time use of the water-oil emulsion, i.e., it must be supplemented and replaced continuously with newly prepared pressure fluid.

Because of these problems, the water-in-oil emulsion released during the retraction of the hydraulic prop for some time has been collected, removed, and then reused in the pump. German DE-GM 89 12 529 describes for instance that the escape of the oil-containing fluid into the mine chamber can be prevented by pressing the pressure fluid via a hydraulically unlocked non-return valve from the same valve case end into the individual prop, and removing it again during the drawing. Thus the pressure medium flows into the return duct during drawing, whereby the drain process may be accelerated with a Venturi tube or similar devices, whereby the pressure fluid is then again used to set the prop. The disadvantage in these known hydraulic props and corresponding valves is the very complex construction of this multipurpose valve which otherwise is known from DE-OS 35 04 878. In order to be able to open the non-return valve, this already complex valve body has a bore which guides the pressure fluid to the rear of the valve case of the pressure-limiting valve, so that the latter is lifted from the valve seat when the non-return valve is loaded correspondingly. Either the pressure fluid must be added via a separate setting gun, or it must have been ensured or must be ensured in a different manner that the pressure fluid cannot flow off through this valve into the prop interior.

SUMMARY OF THE INVENTION

The invention therefore has the task of creating a hydraulic prop with forced return of the pressure fluid which has a filling and drawing valve with a simple construction and is safe to handle during operation.

According to the invention the task is solved in that on both sides of the case identically constructed coupling pieces with gripping grooves and locking shoulders are arranged; that the valve case is associated with a push bolt which may be moved against the force of a return spring against the back wall of the valve case of the pressure-limiting valve and in the process influences the latter, and which may be inserted into the coupling mouth of the setting gun; and that the hose connection is constructed with a drop latch as suction pump connection whose coupling opening surrounds the piston case of the return valve while leaving an annular channel.

A hydraulic prop constructed in this manner firstly ensures that during the drawing the pressure fluid is able to escape quickly and in a proper amount from the hydraulic prop and that in the process it may be collected in such a way that it may be reused subsequently for setting new props. By using the standard setting gun, which now may be attached to the drawing side of the multipurpose valve, it is possible to directly influence the valve case of the pressure-limiting valve and to move it in such a way that the non-return valve hereby is lifted from the valve seat. Because of the direct influence, the large pressure area, and the perfect feeding of the necessary pressure fluid directly to the areas which must be influenced, the effectiveness of the multipurpose valve, and especially that of the non-return valve, is ensured. The pressure conditions in the hydraulic prop itself are not decisive here, especially since the pressure fluid is evenly drawn off via the hose connection and an associated pump. The suction pump connection which is provided according to the invention is hereby constructed in such a way that the connection to the non-return valve has a sufficiently large opening through which the pressure fluid may safely escape, for which purpose the properly proportioned annular channel is provided.

According to a useful embodiment of the invention it is provided that the push bolt has a ring plate which simultaneously functions as spring plate for the return spring and acts as a path limiter which corresponds with a stop bezel of the inside case wall. The push bolt which is influenced via the setting gun is moved against the force of the return spring, whereby the latter acts directly on the push bolt since it supports itself on the ring plate. The stop bezel and the ring plate exactly predefine the length the push bolt moves to open the non-return valve. This prevents an opening which is too wide and on the other hand exactly predefines the opening degree, ensuring that sufficient amounts of pressure fluid may enter by the shortest way from the prop interior into the return duct.

A space-saving embodiment is created according to the invention in that the return spring is arranged in such a way as to surround the valve case of the pressure-limiting valve. This simultaneously results in a guidance of the spring and creates the possibility to make do with a single return spring, since it may be constructed correspondingly.

In order to facilitate installation and hereby to predefine the path of the push bolt at least to a certain extent, it is also provided that the coupling piece which is arranged on the drawing side is constructed as a threaded part which may be inserted into the case. In this way the push bolt may be positioned accurately, since it is pushed into the case before the coupling piece and is then properly positioned and fixated with the screwed-in coupling piece.

The necessary seal in the area of the setting gun/push bolt is ensured in that according to the invention the coupling mouth of the setting gun has a groove which is located on the exit side and accepts an O-ring. This O-ring rests on the corresponding part of the push bolt, so that even with the usual high pressures no pressure fluid is able to enter the area of the pressure-limiting valve or the valve case of the pressure-limiting valve from where it might possibly escape into the environment.

In order to be able to detach and then reuse the setting gun after the drawing of the hydraulic prop, it has been provided that a bypass which reduces the pressure in the area between coupling mouth and sealing valve is located in the setting gun. This bypass is opened when the drawing process is concluded and the grip of the setting gun has been released. A corresponding automatic ensures that the setting gun may be removed after a very brief time.

The embodiment described so far is based on the supposition that the push bolt is an individual unit, therefore also requiring the return spring. It is also conceivable that the valve case of the pressure-limiting valve and the push bolt with ring plate are one structural unit which as such is pushed into the case of the multipurpose valve. To a certain extent, the return spring then may be absent, since the non-return valve then takes over the closing, or reclosing of the non-return valve by itself. Due to the high pressures exerted onto the push bolt via the setting gun, association of a corresponding separate return spring is, however, advantageous.

In an embodiment of the suction pump connection which is adapted to the tight conditions underground, the former is constructed at an angle and equipped with a plug-type connection with plug clamp for the pump hose.

In this way the pump hose may be attached hanging downward at the hydraulic hose so that no problems due to kinking of the hose may occur. The pump hose also may be connected quickly via the plug-type connection with plug clamp to the suction pump connection so that preparation times are accordingly short.

It has already been pointed out above that the solution according to the invention has the great advantage that large volumes of pressure fluid may be discharged via the suction pump connection. Hereby the provided pump unit may have yet another special advantage in that the drain channel in the suction pump connection has a larger, preferably 25 to 50% larger, diameter than the supply bore in the setting gun. This further advantageously reduces the time required for drawing.

The tightness of the non-return valve is ensured advantageously, whereby this valve is optimized in that the seal seat is constructed on an annular support ring which projects into the case interior and on whose opposite support surface the non-return valve spring supports itself. This non-return valve spring ensures that the non-return valve is held in the seal seat with sufficient force, whereby, as mentioned, the seal seat or seal face and on the other side the support surface of the non-return valve spring are adjoining each other very closely.

In order to further optimize the sealing effect of the non-return valve, the invention provides that the support ring has an S-arc-shaped support surface for the non-return valve, whereby the seal seat is formed by the part of the support surface which projects in the direction of the seal shoulder. This ensures that the projecting support surface penetrates or inserts itself into the actual conical nipple in order to secure the necessary seal in this manner.

A permanently tight multipurpose valve is created according to the invention, if the seal piston of the return valve has a valve cone which is to a limited extent flexible, consisting preferably of plastic, or equipped with a corresponding coating. This valve cone rests on the seal seat so that after conclusion of the filling process the prop interior is effectively sealed. Due to the flexible construction of the valve cone, an enduring seal exits even after many operations, something which for instance would not be the case if the seal face were coated with a corresponding material. In this case, the valve cone which then would consist of metal necessarily would be damaged after several operations. Due to the fact that this return valve is important also in regard to the objective, i.e. an environmentally harmless construction of the hydraulic prop, the construction of the seal piston is especially important.

The invention is characterized especially in that a hydraulic prop is created which does not place a burden on the environment, since the used water-in-oil emulsion is unable to escape into the environment even during the various function steps. Rather, it has been ensured that the pressure fluid is always guided in such a way that it remains in the closed space or is returned there by way of hoses, from where it then may be returned into the pressure system following proper compression. Since the return spring in the hydraulic prop by itself is unable to ensure a quick draining of the pressure fluid, it is advantageous that large amounts of pressure fluid here may be discharged quickly via the suction pump connection and the corresponding suction pump. It is also advantageous that the necessary changes made in the multipurpose valve are decidedly simple, so that even existing individual prop valves may be refitted.

For the remainder, standard technology, i.e. the setting gun and the drop latches required by it, is employed so that the miner certainly will be willing to use this optimized technology.

Other details and advantages of the invention are found in the following description of the pertaining drawing which shows a preferred embodiment with the necessary details and individual parts.

DETAILED DESCRIPTION OF THE DRAWINGS

Figure 1:
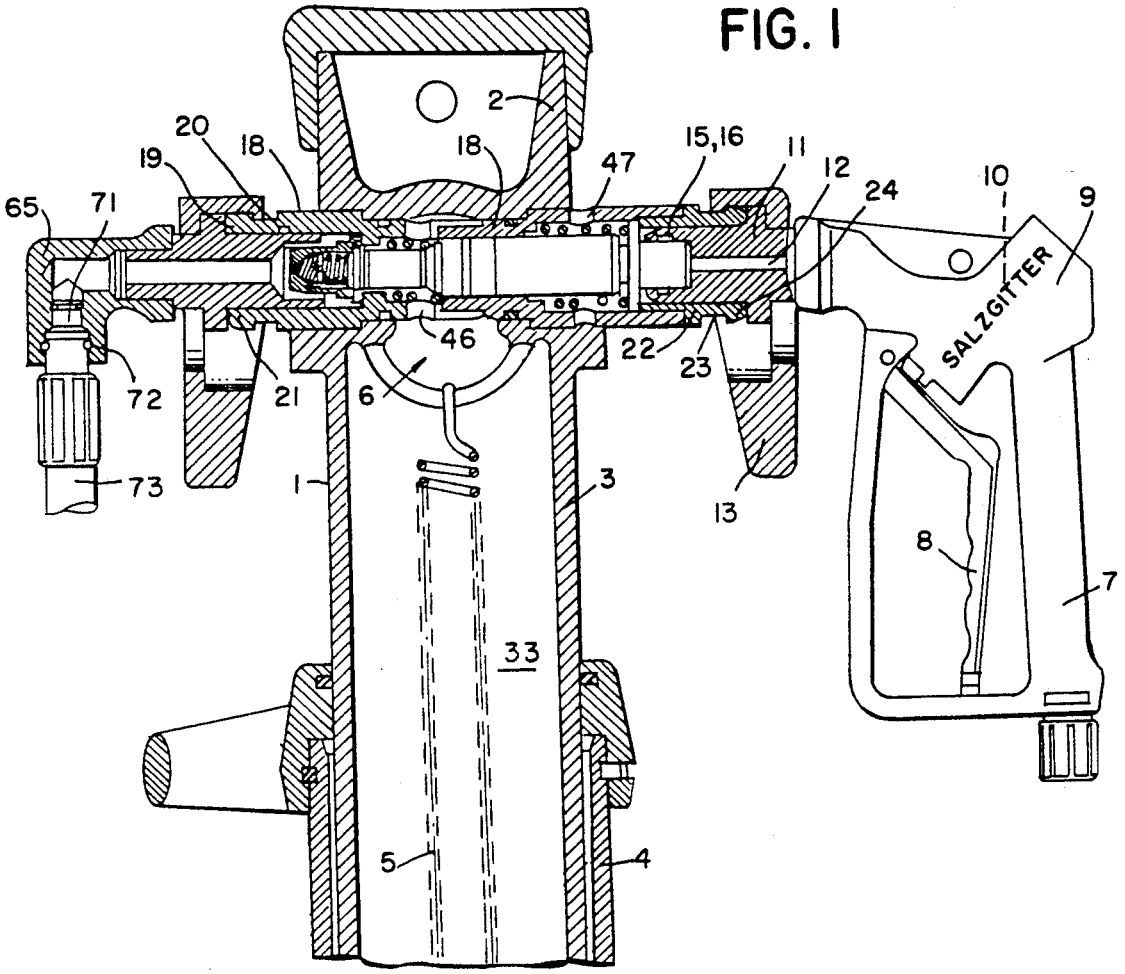
FIG. 1 shows a section of a hydraulic prop with drawing system shortly before initiating the drawing process.
Figure 2:
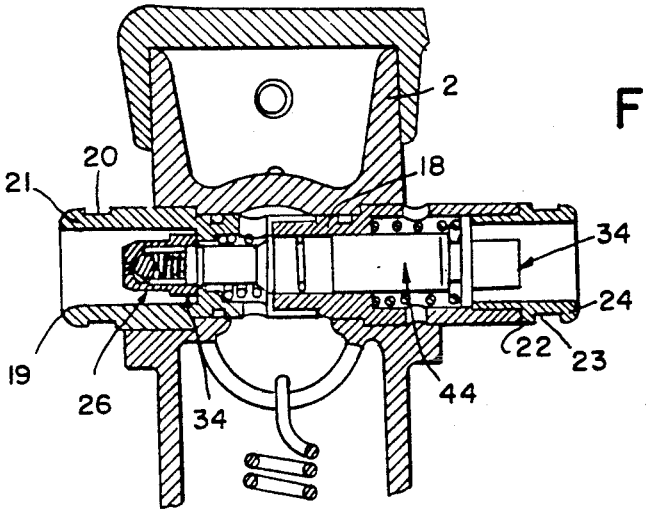
FIG. 2 shows a section of the prop head with individual prop valve.

The hydraulic prop (1) shown in FIG. 1 is shown in its upper part with the prop head (2). The prop head (2) forms the free end of an internal telescopic tube (3) which again is guided in a sliding manner in the external base tube (4). The return spring (5) ensures that during the drawing of the hydraulic prop (1) the telescope (3) slides into the base tube (4). For this purpose, the filling and drawing valve (6) which is associated with the prop head (2) must be opened so that the pressure fluid may drain from the interior of the hydraulic prop (1).

The setting gun (7) which has a sealing valve (9) operated by a handle (8) is used both for filling the hydraulic prop (1) and drawing. This sealing valve (9) may be circumvented via a bypass (10) which is opened when the drawing process or the filling process is concluded, in order to reduce the pressure in the front part of the setting gun (7). The setting gun (7), which has a coupling mouth (11) which has been inserted into the filling and drawing valve (6) and a supply bore (12) constructed in this coupling mouth, is only removed after the drop latch (13) has been released.

The necessary seal in the area of the coupling mouth (11) is achieved by the O-ring (15) which has been set in the groove (16), so that the pressure fluid flowing in through the setting gun (7) is able only to act on the push bolt inserted into the coupling mouth (11) and is not able to pass by this push bolt and reach the area of the valve case of the pressure-limiting valve.

The filling and drawing valve (6) is inserted into the prop head (2) with its case (18) transversely to the longitudinal axis of the hydraulic prop (1). The case (18) projects beyond the telescope tube (3) on both sides, i.e., with its identically constructed coupling pieces (19,22) with gripping groove (20,23) and locking shoulder (21,24). These coupling pieces (19,22) are used to connect the setting gun (7) or the suction pump connection (65).

The return valve (26) for filling the hydraulic prop (1), the non-return valve (34) for drawing, and the pressure-limiting valve (44) for securing the entire hydraulic prop (1) against overload are integrated into the case (18).

Figure 3:
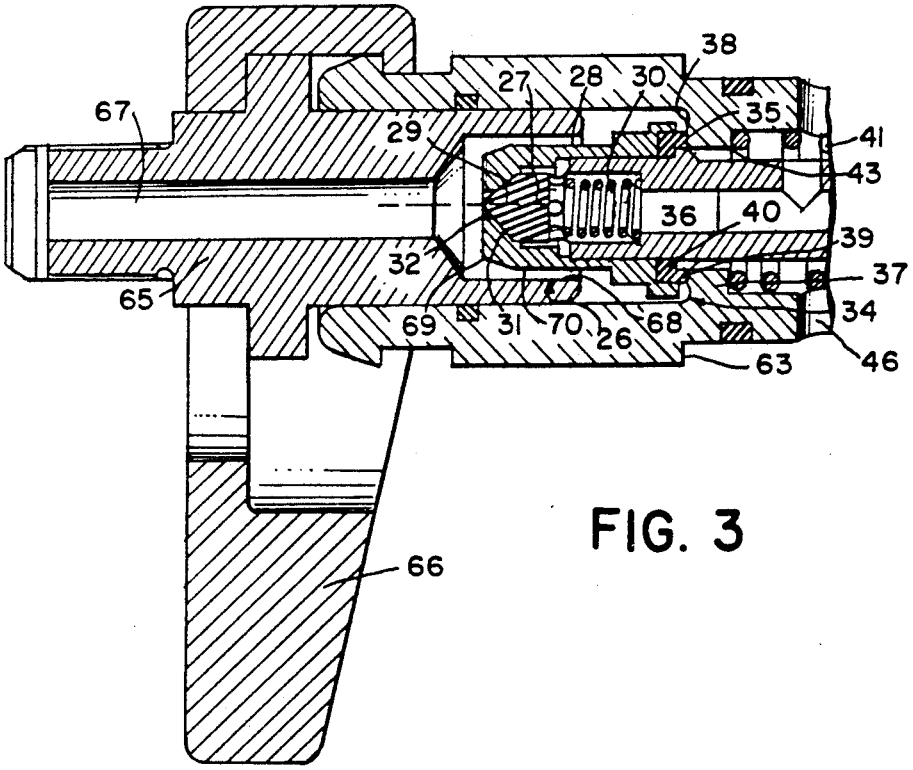
FIG. 3 shows an enlarged view of the filling side of the individual prop valve with attached suction pump connection.

The return valve (26) has a plastic seal piston (27), as is shown especially clearly in FIG. 3, which is inserted with the valve spring (30) into a corresponding space (28) of the case holding the return valve (26). The seal piston (27) with the valve spring (30) is constructed either in its entirety or only in its valve cone (29) of plastic. It is also conceivable that this valve cone (29) which rests on the seal seat (31) is coated with plastic. FIG. 3 here shows that due to the construction of the valve cone (29) or the seal piston (27) as always even, advantageous seal is created. If the seal piston (27) or the valve cone (29) is loaded with pressure when the setting pressure when the setting gun (7) is attached, then the valve cone (29) is pushed out of the seal seat (31) against the force of the valve spring (30), and the pressure fluid is able to flow via the entrance bore (32) into the actual valve. The pressure fluid then flows into the prop interior (33) by way of the prop bore (46) which is also shown in FIG. 1.

The non-return valve (34) consists of the body of the pressure-limiting valve (44) which is moved back and forth accordingly, so that the non-return valve (34) is lifted out of the seal seat (35) in the process, as shown again in FIG. 3.

The seal seat (35) is constructed on a support ring (37) which projects in the direction of the case interior (36), whereby the support surface (38) has the seal seat (35), while the non-return valve spring (41) is able to support itself on the other side, i.e. the support surface (43). FIG. 3 shows an enlargement of this situation.

Figure 4:
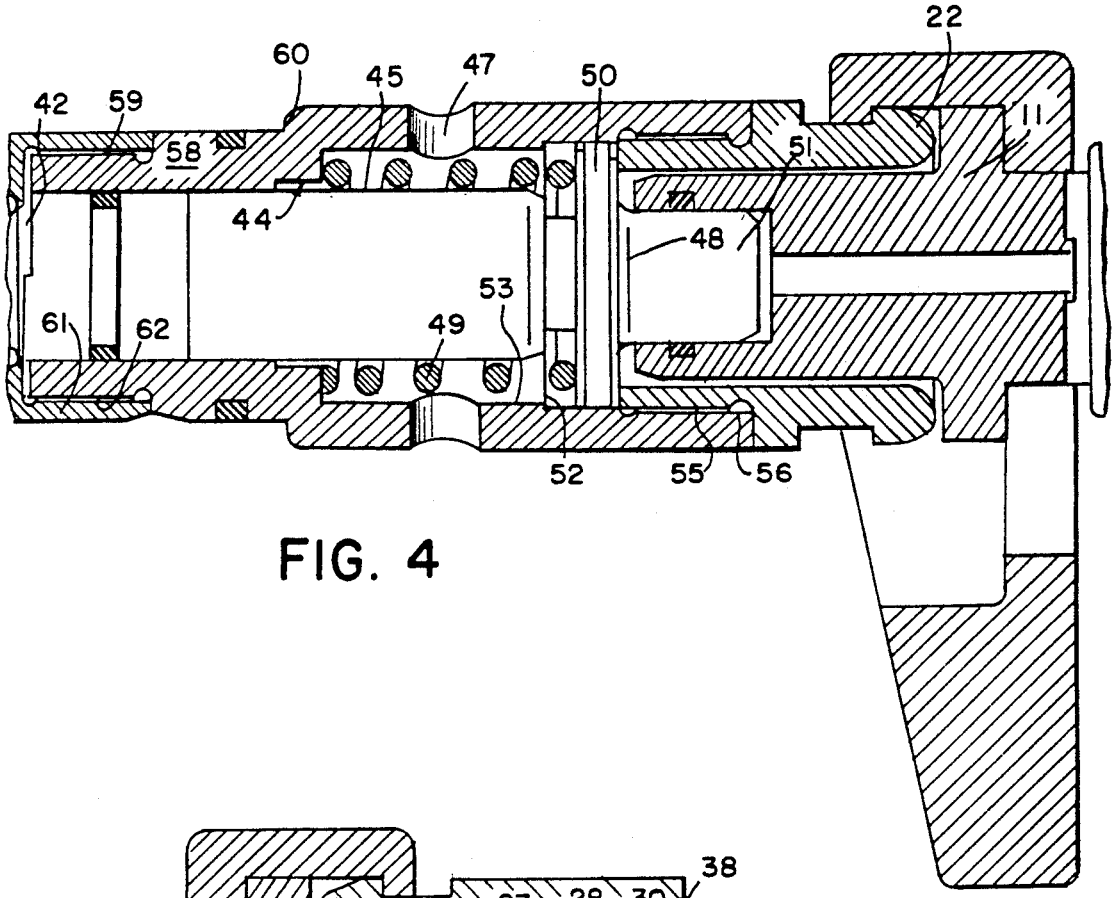
FIG. 4 shows an enlarged view of the drawing side of the individual prop valve with attached setting gun.

The support surface (38) acts together with the seal shoulder (39) which holds the seal body (40), here preferably a plastic or rubber nipple, so that the passing of the seal shoulder (39) to the seal seat (35) ensures the necessary seal. This pressing is performed by the non-return valve spring (41) which, as already explained, supports itself both on the support surface (43) and on a spring washer (42) which is shown in FIG. 4.

In order to eliminate the seal in the area of the non-return valve (34) or of the seal seat (35) and seal shoulder (39), it is necessary that the valve case (45) of the pressure-limiting valve (44) move in the direction of the return valve. For this purpose the push bolt (48) is loaded, as shown in FIG. 1 and FIG. 4, with pressure fluid from the setting gun (7). The push bolt (48) is then moved against the return spring (49) so that the valve case (45) also moves by a corresponding length in the direction of the return valve (26) in the process.

The traveling length of the push bolt (48) is limited by the fact that the ring plate (50) with the stop bezel (52) acts as a path limiter. If this ring plate (50), due to the loading by the pressure fluid, moves from the setting gun (7) against the stop bezel (52), the valve case (45) then cannot be moved any further even if the pressure is sufficiently high, so that the opening degree of the non-return valve (34) is exactly predefined.

It has already been explained above that pressure fluid from the setting gun (7) cannot flow past the push bolt (48) since the plate shoulder (51) is sealed against the coupling mouth (11) by the O-ring (15). FIG. 4 furthermore shows that this coupling piece (22) is a threaded part which then may be used simultaneously to fixate the push bolt (48) also. The inside case wall (53) has a thread (55) corresponding to thread (56) so that the screwing process is easily implemented. The overall construction of the individual prop valve is further facilitated in that the case (18) consists of two parts, i.e. the case part (58) for drawing and the case part (61) for setting. Both must be connected by way of a screw connection (59,62), whereby the shoulders (60,63) permit accurate positioning of the individual prop valve or the filling and drawing valve (6).

FIG. 4 also shows the exit bores (47) through which the excess pressure fluid may be discharged when the pressure-limiting valve (44) responds. In the embodiment shown here, this pressure fluid is discharged into the environment which is not a problem since it concerns relatively small amounts. If this pressure fluid also is to be discharged, a hose connection through which even this pressure fluid is discharged along with the other would have to be provided in the area of the exit bores (47).

FIGS. 1 and 3 show the case part for setting (61) with its suction pump connection (65). This suction pump connection also has a drop latch (66) with which the connection therefore may be established in the same way as for the setting gun (7). The drain channel (67) in the suction pump connection (65) has a distinctly larger diameter than the supply bore (12) in the setting gun (7). This, and the special construction of the non-return valve (34), ensures that a large amount of pressure fluid is drained quickly. The coupling opening (68) in the area of the return valve (26) is hereby proportioned in such a way that a suitably proportioned annular channel (70) remains between it and the piston case (69).

The suction pump connection (65) is constructed, as shown in FIG. 1, at an angle, so that the pump hose (73) may be attached hanging downward. This is achieved with the plug-type connection (7) and plug clamp (72).

During the setting of the hydraulic prop (1), the setting gun (7) is attached to the case part (61) and thus to the coupling piece (19). By operating the handle (8), the prop interior (33) is connected to the pump which is not shown here, so that the pressure fluid is able to flow through the setting gun into the filling and drawing valve (6).

The pressure fluid causes the return valve (26) to open by lifting the seal piston (27) from the seal seat (31). The pressure fluid is then able to flow through the return valve (26) to the prop bore (46) from where it reaches the prop interior (33).

If a rock burst occurs and the pressure-limiting valve (44) must respond, then the pressure fluid flows from the prop interior (33) and the prop bore (46) into the pressure-limiting valve (44) or the valve case (45). Since the seal piston (27) of the return valve (26) is now pressed additionally into the seal seat (31), no pressure fluid can escape here. It is not shown that inside the pressure-limiting valve (44) a small valve piston is provided, which is moved against the force of a valve spring, so that the pressure fluid is then able to quickly flow through the pressure-limiting valve (44) in order to leave the case (18) through the exit bore (47).

If a hydraulic prop (1) is drawn, the arrangement shown in FIG. 1 is realized, i.e. the setting gun (7) is attached to the case part (58) for drawing or to the coupling piece (22), while the suction pump connection (65) is generated or attached on the opposite side. By operating the handle (8), pressure fluid is now passed through the setting gun (7) onto the push bolt (48) or the plate shoulder (51), so that the latter moves by a predefined length. If the ring plate (50) runs against the stop bezel (52), this simultaneously opens the non-return valve (45), since the valve case (45) is moved by the same length and the seal shoulder (39) is lifted from the seal seat (35). Due to the predefined spaces which are shown especially in FIG. 3, the pressure fluid is now able to drain through the case interior (36) past the piston case (69) into the annular channel (70) and from there through the drain channel (67). This draining is further promoted or accelerated by a pump which is connected to the drain channel (67) or the suction pump connection (65).

All mentioned characteristics, including those only found in the drawings, are considered as essential to the invention, be it alone or in combination.

I claim:

1. A hydraulic prop for individual prop supports in underground mining and tunnel construction, comprising a case integrally formed with a prop head for filling and drawing, a first valve on an end side of the case, first and second coupling pieces on the end side for receiving a nozzle of a setting gun and a hose connection respectively, a second valve on an inner end of the nozzle, a third valve at an opposite end of the nozzle for non-returning, and a fourth valve for pressure-limiting and for securing the prop against overload, a valve case of the fourth valve simultaneously forming a piston for the third valve, the piston having a seal shoulder formed adjacent a seal seat on an inside wall of the case and the hose connection being connectable by clamping to the coupling piece for removing the pressure medium in an environmentally harmless manner, wherein on the first and second identically formed coupling pieces are on first and second sides of the case, the first and second coupling pieces having first and second gripping grooves respectively, and first and second locking shoulders, further wherein the valve case is associated with a push bolt movable against a force of a return spring against a back wall of the valve case of the fourth valve thereby influencing movement of the fourth valve, the push bolt being insertable in a coupling mouth of the setting gun, further wherein the hose connection comprises a drop latch connected to a suction pump connection having a coupling opening surrounding a piston case of the first valve thereby forming an annular channel around the piston case.

2. The hydraulic prop of claim 1, further comprising the push bolt having a ring plate simultaneously functioning as a spring plate for the return spring and wherein further the push bolt limits a path of a corresponding stop bezel on an inside of the case wall.

3. The hydraulic prop of claim 1, wherein the return spring surrounds the valve case of the fourth valve.

4. The hydraulic prop of claim 1, wherein the first coupling piece is formed as a threaded part for inserting into the case.

5. The hydraulic prop of claim 1, wherein the coupling mouth of the setting gun has a groove on an exit side, the groove being adapted to receive an O-ring.

6. The hydraulic prop of claim 1, further comprising a bypass between the coupling mouth and a sealing valve located in the setting gun for reducing the pressure.

7. The hydraulic prop of claim 2, wherein the valve case of the fourth valve and the push bolt with the ring plate are one structural unit.

8. The hydraulic prop of claim 1, wherein the suction pump connection is constructed at an angle and equipped with a plug-type connection with a plug clamp for the hose.

9. The hydraulic prop of claim 1, further comprising a drain channel in the suction pump connection having a diameter 25 to 50% larger than a diameter of a supply bore in the setting gun.

10. The hydraulic prop of claim 1, wherein the seal seat is constructed on an annular support ring projecting into an interior of the case, and wherein the non-return valve spring is supported on a surface of the support ring.

11. The hydraulic prop of claim 10, wherein the support ring has an S-arc-shaped support surface for supporting the non-return valve whereby the seal seat is formed by a part of the support surface projecting in a direction of the seal shoulder.

12. The hydraulic prop of claim 1, wherein the seal piston of the second valve has a partially flexible valve cone and is made of plastic.

* * * * *